US006205888B1

(12) United States Patent
Laudani

(10) Patent No.: US 6,205,888 B1
(45) Date of Patent: Mar. 27, 2001

(54) ONE-HANDED CHILDPROOF MEDICINE BOTTLE OPENER

(76) Inventor: David Steven Laudani, 1544-207 Sunbow Falls La., Raleigh, NC (US) 27609

( * ) Notice: Subject to any disclaimer, the term of this patent is extended or adjusted under 35 U.S.C. 154(b) by 0 days.

(21) Appl. No.: 09/281,542

(22) Filed: Mar. 30, 1999

Related U.S. Application Data

(63) Continuation-in-part of application No. 08/897,263, filed on Jul. 18, 1997, now abandoned.

(51) Int. Cl.[7] ..... B67B 7/18
(52) U.S. Cl. ..... 81/3.32; 81/3.4; 269/254 R
(58) Field of Search ..... 81/3.31, 3.25, 81/3.32, 3.36, 3.39, 3.4, 3.44; 269/287, 254 R

(56) References Cited

U.S. PATENT DOCUMENTS 2,061,074 * 11/1936 Holtz .
2,673,481 * 3/1954 Hanson .
2,956,687 * 10/1960 Robichaud .
4,171,650 * 10/1979 Cardinal .
4,807,421 * 2/1989 Araki et al. .

* cited by examiner

*Primary Examiner*—D. S. Meislin
(74) *Attorney, Agent, or Firm*—Dorothy S. Morse

(57) ABSTRACT

A device which can be used with the palm of one hand to manually remove and replace threaded caps on bottles, particularly childproof caps on medicine bottles having a maximum diameter of approximately five inches, and a method for its use. The device comprises a base plate, a top plate having a central opening and being positioned substantially parallel to the base plate, an upright open-ended cylinder connected between the base plate and the top plate, a plurality of flexible flap-like bottle gripping members extending across the upper opening of the cylinder and substantially covering the opening, as well as a gripping mat centrally positioned within the bottom of the cylinder and attached to the upper surface of the base plate. When a bottle needing to have its cap removed or replaced is inserted into the cylinder, the flap-like bottle gripping members are forced downwardly and become biased against the outside surface of the bottle to hold it in an essentially upright orientation. The bottle is inserted until its bottom surface contacts the gripping mat. The gripping mat and the flap-like bottle gripping members in combination hold the bottle in a fixed position so that twisting forces applied to the bottle's cap can remove or replace it. Feet attached to the base plate prevent it from rotating relative to a support surface. Applications may include, but are not limited to, use by weak patients and those with arthritis for completely autonomous self-dosing of medications.

16 Claims, 2 Drawing Sheets

ONE-HANDED CHILDPROOF MEDICINE BOTTLE OPENER

This patent application is a continuation-in-part of patent application Ser. No. 08/897,263 filed on Jul. 18, 1997, now abandoned, by the same inventor herein and claims all benefit allowable thereunder.

BACKGROUND

1. Field of Invention

This invention relates to devices used to open bottles or containers having screw-type closures, specifically to a device which can be used by an adult with the palm of one hand to manually open and close childproof caps on medicine bottles and a method for its use. Applications may include, but are not limited to, use by weak patients and those with arthritis for completely autonomous self-dosing of medications.

2. Background—Description of Prior Art

The introduction of childproof caps on medicine bottles and containers used for the storage of other potentially hazardous products has valiant origins, the safety of curious children. Since children's toys generally teach them to rotate objects at an early age, the removal of childproof caps must require complex skills not easily mastered by small children, such as the use of one hand to apply simultaneous squeezing and horizontal twisting forces to the bottle cap; the use of one hand to apply simultaneous downward axial forces and horizontal twisting forces to the bottle cap; and the simultaneous application of a downward force with one hand to a fastening element attached to the bottle, such as a tab, with a horizontal twisting force simultaneously applied with a second hand to the bottle cap. When a childproof container is large and heavy, such as the two-and-one-half gallon containers commonly used for storing and transporting liquid chlorine used in the treatment of swimming pool water, the approximate twenty pound weight of the liquid stored therein holds the container in place so that an operator can use one hand to downwardly press on its cap and simultaneously rotate the cap to successfully separate it from the container. However, the manual opening of small lightweight bottles having childproof caps, such as medicine bottles, requires more hand strength and coordination since rotational forces applied to the bottle cap also tend to rotate the attached bottle unless it is somehow secured during such rotation. It is common practice for medicine bottles to be generally secured with one hand while a second hand attempts to remove the cap. To do so autonomously, a person must tightly grip the bottle between the palm and fingers of one hand, while simultaneously applying both downward axial forces and horizontal twisting forces with his or her other hand to the childproof cap attached thereto to release and remove it from the bottle. Often, an opposed horizontal twisting force is also applied by the hand gripping the bottle. If a horizontal twisting force is applied to the cap without the downward axial force, such as would be expected from a small child, the cap will turn freely in place and remain attached to the bottle.

A significant disadvantage of childproof caps is that they frustrate many adults who do not have the strength or coordination to easily open them. Such adults, particularly those needing frequent medication, must repeatedly rely on others to help them and they can feel a loss of autonomy. As a result, some commercially available products, such as aspirin, are now again being made available with non-childproof caps for use in households without children. Also, some prescription medications are now sold with dual use screw-type caps, which are configured with opposed threaded surfaces that can be alternatively used by inverting the cap, one surface providing a childproof closure and the other surface providing a more easily opened non-childproof closure. It is then left up to the consumer as to which type of closure will be selected for use. Although the non-childproof caps are convenient for adult use, they continue to pose a risk for children. The present invention solves this dilemma by providing a one-handed, quick and easy way for adults to open and close medicine bottles, including those having a childproof screw-type of cap, which allows continued use of childproof caps by adults not otherwise having the strength or coordination to autonomously remove such caps by hand.

The difficulty of opening childproof caps even by able-bodied adults is well recognized. Improvements in childproof caps have been attempted since their introduction to make them easier for the average adult to open. One such improvement involves a tab on the bottle having an upwardly depending angled protrusion attached thereto that engages a plurality of notches on the underside of a screw-type of cap. To open this type of cap, an operator must downwardly press on the tab with the thumb of the hand holding the bottle, while simultaneously using his or her other hand to untwist the cap to release it. Another childproof cap variation involves the alignment of arrows on both the cap and the bottle, with the subsequent application of upwardly directed forces to the cap with one or both of a person's thumbs to separate the cap from the bottle. Although such caps can be more easily released by able-bodied adults than other known types of childproof caps, those in a weakened state, as well as people with arthritis, still may not always have the hand coordination or strength to easily open these types of caps, or do so without pain.

It is also known to have automated opening devices for containers having screw-type closures, as well as devices which assist the manual opening of such containers. However, most of the automated openers are expensive and complex devices with one or more drive means, and in addition have components which independently engage both the bottle and its cap. In contrast, the present invention grips only the bottle to stabilize it so that a quick and easy downward axial force, combined with a simultaneous horizontal twisting force and applied solely by the palm of one adult hand, will cause prompt release of the attached cap. Also, most of the prior art mannual-assist devices for removing caps from bottles grip the bottle cap and require two hands for operation. No prior art device is known having all of the advantages of the present invention.

SUMMARY OF INVENTION—OBJECTS AND ADVANTAGES

It is the primary object of this invention to provide a one-handed, quick and easy-to-use means for opening medicine bottles having a childproof cap. It is also an object of this invention to provide a means for opening medicine bottles having a childproof cap which can also be used to help an operator replace the cap, and which can be used for assistance in opening containers having non-childproof screw-type caps. A further object of this invention is to provide terminally ill and weak patients with a device that allows them increased autonomy and which alleviates their frustration and embarrassment by allowing them to open and close medicine bottles without having to ask for assistance. It is also an object of this invention to provide a device for opening medicine bottles having a childproof cap which is compact, simple, reliable, durable, aesthetically appealing, and inexpensive to manufacture so as to promote cost-effective home use thereof.

As described herein, properly manufactured and used, the present invention would provide a bottle-opening aid for a person with weak or stiffened hands who requires frequent medication and who might not otherwise be able to autonomously remove and replace a medicine bottle cap without pain or the humiliation of asking for assistance. The present invention provides an enlarged and stable base plate with a gripping mat attached to its upper surface, a smaller top plate having an opening therethrough no more than approximately five-and-one-half to six inches in diameter to accommodate standard sizes of medicine bottles which range between approximately one and five inches in diameter, and a hollow open-ended upright cylindrical member positioned therebetween and into which a medicine bottle is partially inserted while its cap is being removed or replaced. Feet made from a high adhesion gripping material, such as rubber, are attached to the bottom surface of the base plate to prevent it from slipping or twisting relative to the support surface upon which the bottle opening device is placed during use.

The upper opening of the cylindrical member is partially covered by a plurality of opposed flexible flap-like bottle gripping members which leave only a small central aperture having a diameter slightly less than one inch. Since the flap-like members are flexible, as a medicine bottle is inserted through the aperture the flap-like members bend downwardly and remain biased against the outer surface of the medicine bottle until it is removed from the cylinder. To provide ease of assembly and durability during repeated use, it is contemplated for the proximal edges of the flap-like members of the preferred embodiment of the present invention to be joined together and inserted as a one-piece unit within a horizontal recess in the top plate, or between the top plate and the upper edge of the cylindrical member. Such flap-like members can be easily formed from one circular piece of material having linear cuts radiating out from its center with a solid perimeter portion remaining adjacent to the circumference. When six flap-like members are used, the small central aperture is hexagonally shaped with the distance between opposed central edges of the flap-like members being slightly less than one inch to accommodate smaller cylindrically-shaped medicine bottles which may only have a diameter dimension ranging between one inch and one-and-one-fourth inches. Thus when a medicine bottle is downwardly inserted through the top plate opening and into the upright cylindrical member, the flap-like members are also pushed downwardly causing the aperture to become enlarged to the exact size of the bottle, the flap-like members becoming biased against opposed sides of the medicine bottle to hold it in an essentially upright position centrally within the cylindrical member until the bottle is subsequently lifted away from the present invention. It is important that the medicine bottle be completely inserted into the cylindrical member with its bottom surface in maximum contact with the gripping mat attached to the upper surface of the base plate before twisting forces are applied to the bottle cap. Then, while a medicine bottle is in a position where it is firmly held in place by both the bottle gripping members and the gripping mat, an adult can simply and promptly remove the bottle's cap by placing the palm of one hand against the upper surface of the cap and applying sequential downward and twisting forces to the cap with only his or her palm. During the cap removal process, the user's fingers are required to lift the cap from the bottle once the cap is loosened, and reposition the cap against the upper surface of the bottle once the appropriate amount of medication is removed from the bottle, however no finger strength or coordination is needed to loosen and remove a cap from the bottle, even a childproof one.

The present invention helps those with arthritis who would not physically be able to close their fingers around the cap of a medicine bottle and simultaneously apply sufficient force to the cap to twist it, or at least would not be able to do so without pain. It also would help those with weakened hands lacking the coordination to open medicine bottles with child-proof caps, particularly people who must repeatedly take multiple doses of medications during a day. Although not critical to the present invention, in the preferred embodiment the flap-like gripping members would be essentially trapezoidal in shape and formed from a flat and essentially circular piece of flexible material which has a small central aperture and several cuts through the material radiating from the edge of the aperture toward the outer circumference of the material. The lower side edges of the flap-like gripping members would remain attached to one another and their bottom edges would remain arcuate to preserve the overall circular shape of the piece of flexible material. A bonding agent, glue, or adhesive material would be used to securely fasten the gripping mat to the upper surface of the base plate and although not critical could also be used to secure the flap-like gripping members within a horizontally oriented recess in the top plate. In combination, the gripping mat and the flap-like gripping members work together to resist the twisting forces applied to the cap of a medicine bottle positioned within the cylindrical member so that the twisting forces remain focused on the bottle's cap and do not become transferred to the medicine bottle or the opening device itself. During cap removal the flap-like gripping members hold a medicine bottle in an essentially upright orientation to maximize contact between the bottom of the medicine bottle and the upper surface of the gripping mat.

At least one indentation can also be formed into the upper surface of the base plate to provide an additional convenience for a user, particularly when the user needs to take multiple medications at one time. Medication removed from each successive medicine bottle can be temporarily retained within the indented area where it remains conveniently consolidated while bottle caps are replaced and other medication is removed from additional medicine bottles. Although one large indentation is preferred, more than one indentation is also contemplated and could be helpful in situations where one medication must be eaten before a meal, while other medication is scheduled after the meal. A person could then conveniently remove from their original bottles all at once all of the medication to be taken within a short interval, yet maintain one or more medications distinct from the others. Although the present invention is particularly contemplated for use in removing childproof caps, it can also be conveniently used to remove non-childproof caps and used by people with arthritic or otherwise weakened hands to tighten caps securely around the upper openings of medicine bottles after replacement. Since the present invention is not a complex device, it would be easy and reliable to use. Also, since the preferred embodiment of the present invention is compact in design and made from lightweight molded plastic materials, it would be easily portable and less expensive to use than bottle openers having automated drive means.

The description herein provides preferred embodiments of the present invention but should not be construed as limiting the scope of the one-handed medicine bottle opening device. For example, variations in the number of flap-like bottle gripping members cut into the circular material partially covering the upper opening in the cylindrical member, the height of the cylindrical member, the translucency of the material from which the cylindrical member is made, the configuration and number of indentations used to consolidate medications removed from the medicine bottles, the number and positioning of gripping feet used, the type of high-adhesion material from which the mat, the feet, and the flap-like gripping members are made, and the configuration and dimension of the enlarged base member, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
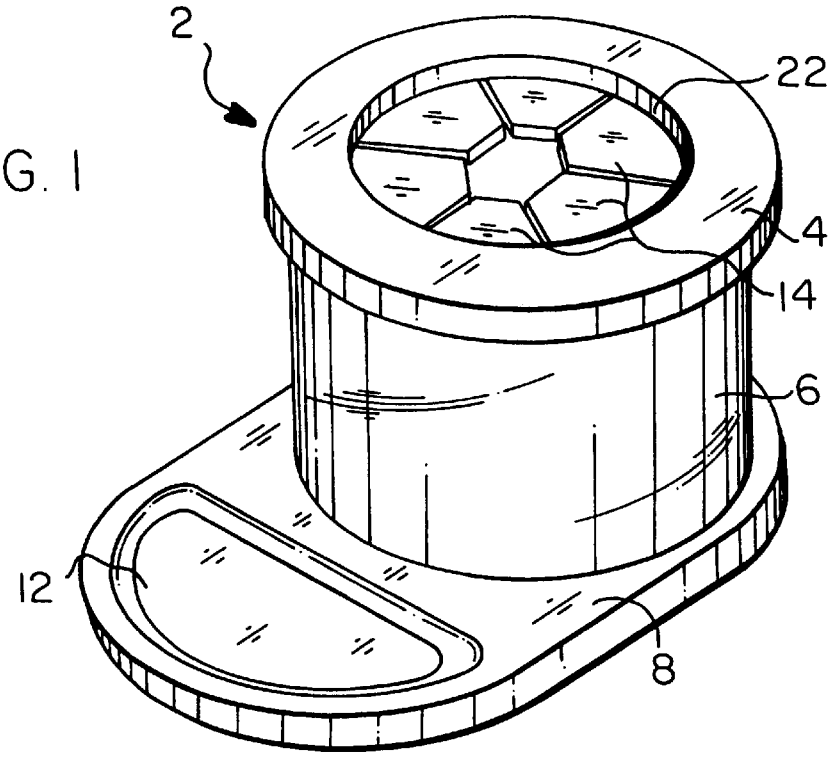
FIG. 1 is a perspective view of the present invention having an essentially circular top plate, an elongated base plate, an upright cylindrical member positioned therebetween, several flap-like gripping members positioned between the top plate and the cylindrical member partially covering the upper opening of the cylindrical member, as well as an indentation in the upper surface of the base plate adjacent to the cylindrical member for the temporary storage and consolidation of medications.

FIG. 1 shows a preferred embodiment of a medicine bottle opener 2 having an essentially planar top plate 4, an essentially planar base plate 8 positioned substantially parallel to and below top plate 4, and an upright cylindrical member 6 positioned therebetween. Although not shown in FIG. 1, cylindrical member 6 is hollow and open-ended and attached to both base plate 8 and top plate 4. It is not critical whether medicine bottle opener 2 is made as a one-piece unit from molded construction, or whether the combination of top plate 4, base plate 8, and cylindrical member 6 form an assembled unit. However, during use top plate 4, base plate 8, and cylindrical member 6 must not be movable relative to one another. While FIG. 1 shows top plate 4 and base plate 8 being made from materials having a similar thickness dimension, such dimension considerations are not critical. In the preferred embodiment the thickness dimensions of top plate 4 and base plate 8 would be that required to give them sufficient rigidity to resist twisting forces applied to a medicine bottle cap, shown as number 20 in FIG. 2, without adding an undue amount of weight to the present invention.

FIG. 1 also shows top plate 4 having a circular configuration with a central circular opening 22. Although a circular configuration for top plate 4 and opening 22 is preferred, neither is critical and it is equally contemplated for top plate 4 to have an outer perimeter with a hexagonal, octagonal, square, or other configuration. At a minimum, it would be preferred for top plate 4 to have a configuration without sharp protruding edges for enhanced safety and ease of use. Also as shown in FIG. 1, it is preferred for cylindrical member 6 to have the shape of a cylinder with a diameter dimension slightly less than the diameter dimension of top plate 4. However, the configuration of cylindrical member 6 is not critical as long as its hollow interior is adequate to house the size of medicine bottle, shown as number 18 in FIG. 2, contemplated for use. FIG. 1 also shows base plate 8 being larger than top plate 4 and having an elongated configuration to enhance the stability of medicine bottle opener 2 during use. The dimension and configuration of base plate 8 should be such as to provide stable support of bottle 18 during removal and replacement of cap 20 therefrom, however, base plate 8 should also remain sufficiently compact to make it convenient and easy to use. The preferred embodiment of base plate 8 also has rounded edges although a rounded configuration is not critical to its function. Also not critical, although preferred, it is contemplated for cylindrical member 6 to be attached to base plate 8 near to one of its ends so that an indentation 12 may be made in the upper surface of the other end of base plate 8 for the temporary storage of medications which have been removed from medicine bottles 18. In FIG. 1, although not critical, indentation occupies approximately one-fourth to one-third of the upper surface area of base plate 8. Indentation 12 should have a configuration which does not makes it difficult for a user (not shown) of medicine bottle opener 2 to pick up the medications (not shown) temporarily stored therein. FIG. 1 shows indentation 12 as a single enlarged cut-out area in the upper surface of base plate 8 and having an essentially semi-circular configuration, however, although not shown it is also contemplated for indentation 12 to have different configurations such as a crescent shape, for indentation 12 to be sufficiently large to simultaneously hold a dozen or more capsules so that medication (not shown) can be removed successively from several medicine bottles 18, for indentation 12 to be divided into two or more compartments for separation of selected medications, and for base plate 8 to have more than one indentation 12 in its upper surface for separation of medications.

FIG. 1 further shows flap-like bottle gripping members 14 positioned under opening 22 and substantially covering the upper open end of cylindrical member 6. It is contemplated for flap-like bottle gripping members 14 to be made from a flexible high-adhesion material, such a soft plastic, foam, or rubber. Flap-like bottle gripping members 14 appear trapezoidal in shape and separate from one another. Although the preferred embodiment shown in FIG. 1 has six flap-like bottle gripping members 14, the number and configuration of flap-like bottle gripping members 14 used is not critical to the present invention as long as flap-like bottle gripping members 14 collectively can hold a medicine bottle positioned therebetween in a fixed position without rotation. In the preferred embodiment it is contemplated for flap-like gripping bottle members 14 to permit secure positioning of medicine bottles 18 ranging in diameter from a minimum dimension of approximately one inch to a maximum dimension of approximately five inches so as to accommodate the width dimension of commonly available sizes of medicine bottles 18.

Although the use of other materials would be possible, in the preferred embodiment it is contemplated for base plate 8, top plate 4, and cylindrical member 6 to all be made from a rigid, lightweight plastic. At a minimum the material should be washable so that indentation 12 can be kept clean for the temporary storage of oral medications. In the preferred embodiment it is also contemplated for cylindrical member 6 to be transparent, although transparency is not critical to the present invention. Transparency can enhance the aesthetic appearance of medicine bottle opener 2, but it also can permit a quick view of medication instructions on the surface of medicine bottle 18 without having to withdraw medicine bottle 18 from cylindrical member 6. The length of cylindrical member 6 is not critical, however, the overall height of the present invention should be suitable to accommodate the standard heights of currently available medicine bottles 18 so that an optimal center of gravity is present to provide easy use. Generally in the preferred embodiment, at least one half of medicine bottle 18 is positioned within cylindrical member 6 during use. Even though it is preferred for base plate 8, top plate 4, and cylindrical member 6 to all be made from the same material, it is within the scope of the present invention for top plate 4, base plate 8, and cylindrical member 6 to each be made from different types of material, materials having a different color composition, materials having a different surface texture, and materials having a different transparency. Also, although the embodiment of the present invention which can accommodate medicine bottles 18 ranging between one and five inches is preferred, it is considered within the scope of the present invention to have more than one size of medicine bottle opener 2, for example, an embodiment which would accommodate smaller medicine bottles 18 ranging in diameter between one and three inches, or one which would accommodate medicine bottles 18 ranging in diameter between one and four inches. The goal is for medicine bottle opener 2 to be compact in configuration so that it is easily handled and used by people with reduced hand strength and coordination, and easily transported from one location to another. Although medicine bottle opener 2 is particularly suited for opening the common sizes of container used to store medications, such as medicine bottle 18, medicine bottle opener 2 is not restricted to such use and can also be used to open other similarly sized containers, such as bottles containing spices, vitamins, baby food jars, and screw-topped containers into which small sewing or craft supplies have been placed.

Figure 2:
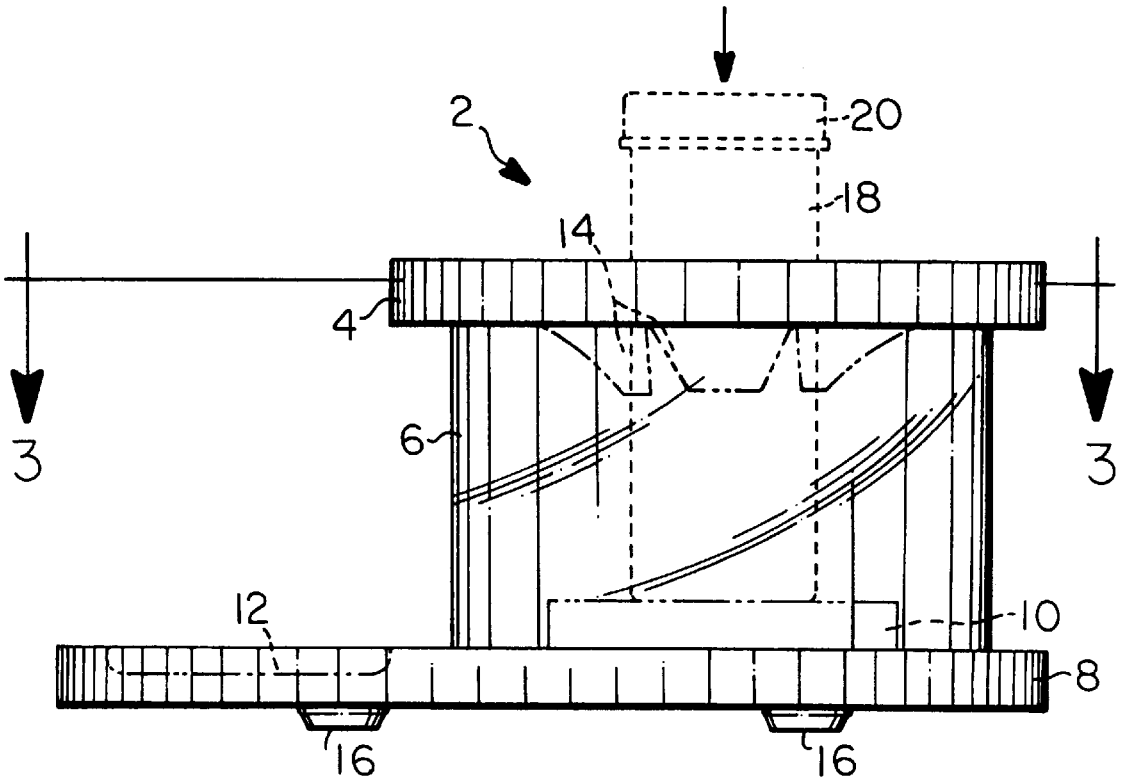
FIG. 2 is a side view of the present invention with approximately the bottom half of a medicine bottle positioned within the upright cylindrical member, flap-like gripping members downwardly directed and biased against the outside surface of the medicine bottle to hold the medicine bottle in an upright orientation and the gripping mat in contact with the bottom of the medicine bottle to prevent rotation of the medicine bottle when twisting forces are applied to the bottle's cap, the bottom of the base plate also having gripping feet attached thereto and the upper surface of the base plate having an indentation for the temporary storage and consolidation of medications.
Figure 3:
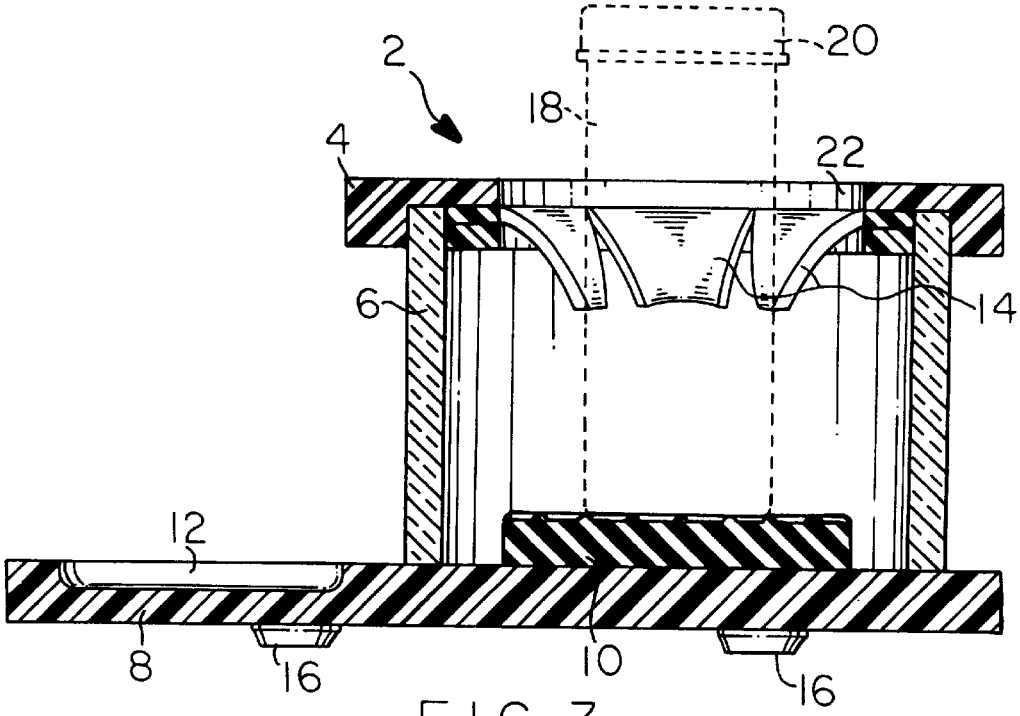
FIG. 3 is a sectional side view of the present invention taken from line 3—3 in FIG. 2 with approximately the bottom half of a medicine bottle positioned within the upright cylindrical member, flap-like gripping members downwardly directed and biased against the outside surface of the medicine bottle to hold it in an upright orientation and the gripping mat in contact with the bottom of the medicine bottle to prevent rotation of the medicine bottle when twisting forces are applied to the bottle's cap, the bottom of the base plate also having gripping feet attached thereto and the upper surface of the base plate having an indentation for the temporary consolidation and storage of medications.

FIGS. 2 and 3 show the preferred embodiment of medicine bottle opener 2 having base plate 8, top plate 4 positioned substantially parallel to and above base plate 8, and cylindrical member 6 vertically positioned therebetween. FIGS. 2 and 3 also show a gripping mat 10 in contact with the upper surface of base plate 8 and centrally positioned within cylindrical member 6, indentation 12 centrally positioned in the portion of the upper surface of base plate 8 adjacent to cylindrical member 6, and feet 16 attached to the lower surface of base plate 8 and downwardly depending therefrom. FIGS. 2 and 3 further show the lower half of a medicine bottle 18 having a cap 20 centrally positioned within cylindrical member 6 with flap-like bottle gripping members downwardly directed around the central portion of medicine bottle 18. Although not shown in FIG. 2 or FIG. 3, in the preferred embodiment it is contemplated for gripping mat 10 to be made from a high-adhesion material such as rubber and to have a textured surface configuration to enhance bottle gripping, or both. Gripping mat 10 must be secured to the upper surface of base plate 8 since gripping mat 10 is used to position and stabilize medicine bottle 18 by gripping the bottom of bottle 18 while forces are applied to bottle cap 20 to remove or replace it. Flap-like bottle gripping members 14 support medicine bottle 18 in an essentially upright position within cylindrical member 6 so that maximum contact between gripping mat 10 and the bottom of medicine bottle 18 is achieved. Adhesive means (not shown) may be used to secure gripping mat 10 to the upper surface of base plate 8, but are not critical if gripping mat 10 is otherwise secured into position to resist rotation when twisting forces are applied to cap 20. Although not shown in FIG. 2 or FIG. 3, gripping mat 10 may also be positioned within a recess in the upper surface of base plate 8. Further, although not shown in FIG. 2 or FIG. 3, it is within the scope of the present invention to have an embodiment wherein either cylindrical member 6 or top plate 4 is separable from base plate 8, or top plate 4 is separable from cylindrical member 6, to facilitate replacement of gripping mat 10 if it should become worn from repeated use. Removable attachment of cylindrical member 6 or top plate 4 could be by threaded means, although it should not be limited thereto. Feet 16 must be made from a high-adhesion, gripping material since they function to prevent rotation of base plate 8 relative to the surface upon which medicine bottle opener 2 is placed when horizontal twisting forces are applied to cap 20 to effect removal of cap 20 from, and replacement of cap 20 upon, medicine bottle 18. The number and positioning of feet 16 attached to base plate 8 is not critical as long as the number and positioning is sufficient to maintain base plate 8 is a fixed position during use. FIG. 3 additionally shows flap-like gripping members 14 being secured within top plate 4 and the thickness of the wall of cylindrical member 6 being less than the thickness of top plate 4 and bottom plate 6. With bottle 18 positioned as shown in FIGS. 2 and 3, an operator (not shown) need only apply a downward compression force with the palm of one hand against cap 20 and simultaneously apply a horizontal twisting or turning force with the same hand to cap 20 to remove cap 20 from bottle 18. A similar "palm and turn" one-handed motion applied in the opposite direction is required by the operator to replace and secure bottle cap 20 on the upper end of bottle 18. Although not shown, it is contemplated for the present invention to be used to remove and replace caps 20 from the upper end of any substantially straight-walled bottle 18 having a maximum width dimension of approximately five inches, whether or not the cap 20 removed is a childproof cap or not. However, the most common application of the present invention is perceived to be the removal and replacement of childproof caps 20 from prescription medicine bottles 18.

Figure 4:
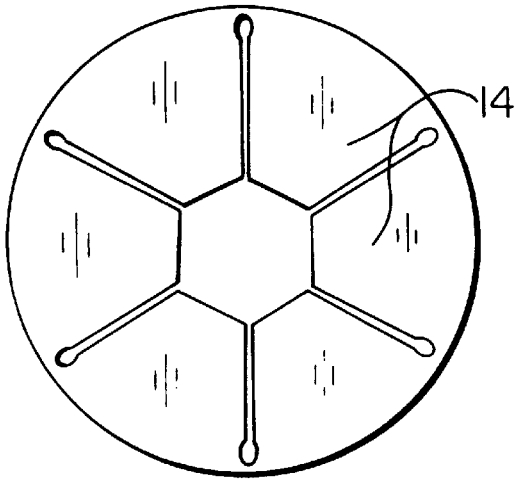
FIG. 4 is a top view of the circular flexible material out of which the flap-like gripping members of the preferred embodiment are formed and showing the flap-like gripping members having an essentially trapezoidal configuration with an arcuate bottom edge and connected together laterally near to their bottom edges so that the bottom arcuate edges form the circumference of a circle.

FIG. 4 shows six flap-like bottle gripping members 14 made as a single unit from a circular piece of material.

Although six flap-like bottle gripping members 14 are shown in FIG. 4 to be sufficient to accomplish the task of stabilizing medicine bottle 18 within cylindrical member 6, any number of flap-like bottle gripping members 14 could be used as long as medicine bottle 18 is stabilized within the center of cylindrical member 6 in an essentially upright position to allow maximum contact between the bottom of medicine bottle 18 and gripping mat 10. Also, to obtain equal pressure against opposed sides of medicine bottle 18 and cause it to remain in the needed upright position during removal and replacement of cap 20, all flap-like bottle gripping members 14 would have approximately the same length and width dimensions. When six flap-like bottle gripping members are used, as shown in FIG. 4, the small central aperture between opposed flexible flap-like bottle gripping members 14 has a hexagonal configuration. It is necessary that the central aperture between opposed flap-like bottle gripping members 14 be at least slightly smaller than the smallest medicine bottle 18 contemplated for use with medicine bottle opener 2. In the preferred embodiment of the present invention which could accommodate medicine bottles 18 having diameter dimensions ranging between approximately one and five inches, the central aperture would have a diameter dimension slightly less than one inch. Although flap-like bottle gripping members 14 could be individually formed and attached to top plate 4 or the upper surface of cylindrical member 6, to provide ease of assembly of the present invention and durability of flap-like bottle gripping members 14 during repeated use, it is contemplated for their proximal edges to be joined together, as shown in FIG. 4, and inserted as a one-piece unit within a horizontal recess in top plate 4, as shown in FIG. 3. To easily create flap-like bottle gripping members 14 with partially joined lateral edges, as shown in FIG. 4, one could start with a circular piece of material, make a central hole therein, and subsequently make six linear cuts radiating out from the center aperture toward its circumference which end before intersecting with the material's circumference. Since flap-like bottle gripping members 14 are made from flexible material, as medicine bottle 18 is inserted downwardly through opening 22 and into cylindrical member 6, each flap-like bottle gripping member 14 is also pushed downwardly causing the center aperture therebetween to become enlarged to the exact size of the outside diameter dimension of medicine bottle 18 and remains biased against the outer surface of medicine bottle 18 to hold it in an essentially upright position centrally within cylindrical member 6 until medicine bottle 18 is subsequently withdrawn from cylindrical member 6.

Figure 5:
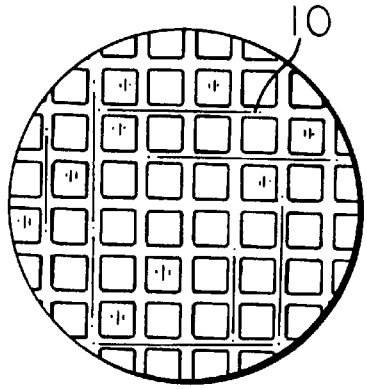
FIG. 5 is a top view of one embodiment of the gripping mat of the present invention having a textured upper surface for enhanced gripping of the surface of a medicine bottle.

FIG. 5 shows the upper surface of gripping mat 10 in the preferred embodiment of the present invention having a textured configuration for enhanced gripping of the bottom of medicine bottle 18. Although a gridded pattern is shown in FIG. 5, other grip-enhancing textured patterns are within the scope of the present invention. However, as long as gripping mat 10 is made from a sufficiently soft high-adhesion material, but not too soft to exhibit excessive wear during use, the use of a textured upper surface on gripping mat 10 is not critical.

To use the preferred embodiment of medicine bottle opening device 2, an operator (not shown) would place base plate 8 upon a stable, rigid surface (not shown) such as a countertop or a table top. The operator would then pick up medicine bottle 18 in one hand by cap 20 and place the bottom of medicine bottle 18 through the opening in top plate 4 and between the flap-like bottle gripping members 14. Depending on its diameter dimension, larger medicine bottles 18 in particular may have to be tilted from a vertical orientation for initial insertion through opening 22 and the center aperture between flap-like bottle gripping members 14. Once medicine bottle 18 is positioned between flap-like bottle gripping members 14, the operator must continually apply a downward force to the upper portion of medicine bottle 18 until the bottom surface of medicine bottle 18 comes to rest upon the top surface of gripping mat 10 within transparent cylindrical member 6. To be in an optimum position for removal of cap 20, medicine bottle 18 should be in an essentially upright position within cylindrical member 6 and with its bottom surface completely resting against the upper surface of gripping mat 10. Once medicine bottle 18 is secured by both flap-like bottle gripping members 14 and gripping mat 10, the operator can apply a downwardly directed vertical compression force and a simultaneous horizontal twisting force with the palm of one hand (not shown), to cap 20 and cause cap 20 to become loosened from medicine bottle 18. Once loosened, cap 20 can be easily lifted away from the upper surface of medicine bottle 18 by the operator. If medicine bottle 18 is filled with a sufficient amount of medication (not shown) that makes the needed dose easily accessible to the operator, the required amount of medication can be removed from medicine bottle 18 while it remains within cylindrical member 6. However, when the level of medication within medicine bottle 18 is low and the medication cannot be reached by the operator, the operator must remove medicine bottle 18 from medicine bottle opening device 2. Medicine bottle 18 can then be tilted or up-ended for access to the medication therein. Removed medication can be temporarily stored and consolidated within indentation 12 while cap 20 is replaced on medicine bottle 18 either with the use of the present invention or by hand, and while the present invention is used to remove and replace caps 20 from additional medicine bottles 18 when necessary. To use the present invention to replace cap 20 on the upper end of bottle medicine 18, medicine bottle 18 is again positioned within cylindrical member 6 and held in an essentially upright position by gripping mat 10 and flap-like bottle gripping members 14 to resist horizontal twisting forces, while similar but opposed forces are applied to cap 20 to again securely attach it to the upper end of bottle 20.

What is claimed is:

1. A compact device for easy one-handed removal and replacement of a childproof cap from a lightweight bottle having a lower end and a maximum width dimension of approximately five inches, said device comprising:

a rigid base plate having an upper surface and a bottom surface;

a rigid top plate having a central opening, said top plate being positioned above said base plate and substantially parallel to said base plate, said central opening having a maximum width dimension of approximately six inches;

a rigid upright open-ended hollow member connected between said upper surface of said base plate and said top plate, said open-ended hollow member having a top end and a bottom end;

a plurality of flexible high-adhesion flap-like bottle gripping members extending across and substantially covering said top end of said open-ended hollow member and configured so as to create a central bottle insertion aperture having a diameter slightly less than one inch;

at least three high-adhesion gripping feet attached to said bottom surface of said bottom plate; and a high-adhesion gripping mat centrally positioned within said bottom end of said open-ended hollow member and secured to said upper surface of said base plate so that when the lower end of a substantially straight-walled lightweight bottle having a childproof cap is placed into said open-ended hollow member and against said gripping mat with the childproof cap remaining exposed through said central opening in said top plate, said flap-like bottle gripping members and said gripping mat in combination secure the bottle in place without rotation while a combined downward and horizontal rotational force applied to the childproof cap with the palm of one adult hand without the use of fingers can be used to remove and replace the childproof cap.

2. The device of claim 1 wherein said open-ended hollow member has a cylindrical configuration.

3. The device of claim 1 further comprising at least one indentation cut into said upper surface of said base plate.

4. The device of claim 1 wherein said flap-like bottle gripping members are attached to one another and positioned within a horizontal recess in said top plate.

5. The device of claim 4 wherein said flap-like bottle gripping members are substantially trapezoidal in configuration and are from a single circular piece of high-adhesion material.

6. The device of claim 1 having six of said flap-like bottle gripping members.

7. The device of claim 1 wherein said open-ended hollow member is made from transparent materials.

8. The device of claim 1 wherein said open-ended hollow member, said top plate, and said base plate are made from lightweight plastic materials as a one-piece unit through molded construction.

9. A compact device for easy one-handed removal and replacement of a childproof cap from a lightweight bottle having a lower end and a maximum width dimension of approximately five inches, said device comprising:

a rigid base plate having an upper surface and a plurality of feet;

a rigid top plate having a central opening; said top plate being positioned above said base plate and substantially parallel to said base plate, said central opening having a maximum width dimension of approximately six inches;

a rigid hollow, open-ended essentially upright cylindrical member connected between said upper surface of said base plate and said top plate;

a plurality of flexible flap-like bottle gripping members positioned within said central opening and configured so as to collectively leave a central bottle insertion aperture having a diameter slightly less than one inch; each of said flap-like bottle gripping members being made from high-adhesion material; and a gripping mat made from high-adhesion material and positioned upon said upper surface of said base plate so that when the lower end of a lightweight bottle having a childproof cap is placed between said flap-like bottle gripping members and the lower end is positioned against said gripping mat with the childproof cap remaining exposed through said central opening in said top plate, said gripping mat and said flap-like bottle gripping members in combination secure the bottle in place without rotation so that the palm of one adult hand without the use of fingers can be used to exert a downward axial force in combination with a horizontal twisting force to remove and replace the childproof cap.

10. The device of claim 9 further comprising at least one indentation cut into said upper surface of said base plate.

11. The device of claim 9 wherein said cylindrical member is made from transparent material.

12. The device of claim 9 wherein said cylindrical member, said top plate, and said base plate are made from lightweight plastic materials as a one-piece unit through molded construction.

13. A method for one-handed removal and replacement of a childproof cap from a lightweight bottle having a lower end and a maximum width dimension of approximately five inches, said method comprising the steps of:

providing a rigid base plate with high-adhesion feet attached its bottom surface, a rigid top plate having a central opening with a maximum width dimension of approximately six inches, a rigid open-ended cylindrical member having a width slightly exceeding the width of the largest bottle contemplated for cap removal and replacement by said method, a plurality of flap-like bottle gripping members, a gripping mat, and a bottle having a threaded childproof cap;

placing said base plate upon a stable rigid surface;

connecting said cylindrical member in an essentially upright position to said base plate;

securing said gripping mat centrally within the bottom of said cylinder to said base plate placing said top plate above said base plate in a position approximately parallel to said base plate;

connecting said cylindrical member in an essentially upright position to said top plate;

attaching each of said flap-like bottle gripping members to said top plate so that said flap-like bottle gripping members substantially cover the upper opening in said cylindrical member with the exception of a central bottle insertion aperture having a diameter slightly less than one inch;

lifting said bottle by said threaded childproof cap;

sequentially placing said lower end of said bottle through said bottle insertion aperture between said flap-like bottle gripping members, and through said upper opening in said cylindrical member;

continuing to downwardly insert said lower end of said bottle into said cylindrical member until said lower end of said bottle comes to rest upon said gripping mat;

after said bottle is in firmly contact with said gripping mat, applying a downward vertical compression force and a horizontal twisting force with the palm of one hand without the use of fingers to said threaded childproof cap to loosen its engagement with said bottle; and lifting said threaded childproof cap from said bottle.

14. The method of claim 13 further comprising the steps of reinserting said bottle into said cylindrical member whereby said flap-like bottle gripping members each become downwardly forced into a position biased against the outer surface of said bottle; positioning said lower end of said bottle for maximum contact with said gripping mat; and applying a downward vertical compression force and a horizontal twisting force with one adult hand to said threaded childproof cap with application of said horizontal twisting force being in a direction opposite to the horizontal twisting force used to loosen engagement of said threaded childproof cap from said bottle.

15. The method of claim 13 wherein said step of providing said cylindrical member further comprises the step of providing a cylindrical member made from transparent materials.

16. The method of claim 13 wherein said steps of providing said gripping mat and said flap-like bottle gripping members further comprises the steps of providing a gripping mat and flap-like bottle gripping members made from high-adhesion materials.

* * * * *